United States Patent [19]

Wibben

[11] Patent Number: 4,753,450

[45] Date of Patent: Jun. 28, 1988

[54] ROLLING CONSTRUCTION PLATFORM

[76] Inventor: Warren Wibben, 26 Cresent St., Whitman, Mass. 02382

[21] Appl. No.: 61,959

[22] Filed: Jun. 15, 1987

[51] Int. Cl.[4] ..... B62D 1/12; B62D 21/12

[52] U.S. Cl. ..... 280/415 R; 180/19.2; 280/789; 296/182; 296/196

[58] Field of Search ..... 280/415 R, 415 A, 415 B, 280/656, 30, 400, 491 R, 785, 789; 296/181, 182, 196, 204, 10; 180/19.1, 19.2, 14.1

[56] References Cited

U.S. PATENT DOCUMENTS

| | | | |
|---|---|---|---|
| 2,801,864 | 8/1957 | Raney | 280/656 |
| 3,697,098 | 10/1972 | Fisher | 280/415 R |
| 3,829,115 | 8/1974 | Rich | 280/656 |
| 3,885,691 | 5/1975 | Knapp | 280/656 |

FOREIGN PATENT DOCUMENTS

| | | | |
|---|---|---|---|
| 720196 | 4/1942 | Fed. Rep. of Germany | 280/656 |
| 639700 | 6/1928 | France | 280/785 |

*Primary Examiner*—John J. Love

*Assistant Examiner*—Everett G. Diederiks, Jr.

[57] ABSTRACT

The following specification discloses a rolling construction platform which can be easily converted for over the road transportation. The rolling construction platform for supporting staging comprising a first frame support section and a second frame support section. The first and second support sections each have a forward terminal end and a back terminal end. The forward terminal end of the first frame support section having a pair of wheels engaged therewith and the back terminal end of the second frame support section having a pair of wheels engaged therewith. When the back terminal end section of the first frame support section is connected to the forward terminal end of the second frame support section, the rolling construction platform is formed and when the forward terminal end section of the first frame support section is connected to the rear terminal end of the second frame support section, the two pairs of wheels are placed in tandem to provide for over the road transportation.

6 Claims, 1 Drawing Sheet

ROLLING CONSTRUCTION PLATFORM

BACKGROUND OF THE INVENTION

This invention relates generally to a construction platform and more specifically to rolling construction platform which can be easily converted into a trailer for over the road transportation.

SUMMARY OF THE INVENTION

The following specification discloses a rolling construction platform for supporting staging comprising a first frame support section and a second frame support section. Both the first and second frame support sections have means of supporting staging and each include a first and second long side frame members, a forward frame member, a back frame member and a series of spaced cross members. The first and second long side frame members each having a forward terminal end, a back terminal end and a lower surface. The forward frame member connecting the forward terminal ends of the first and second long side frame members and the back frame member connecting the back terminal ends of the first and second long side frame members, the cross members connected across the area defined by the first and second long side frame members. The forward frame member and the back frame member each have a pair of wheels and are connected in end to end relation to form the rolling construction platform and connected in reverse to place the two pairs of wheels in tandem to provide a trailer for over the road transportation.

BRIEF DESCRIPTION OF THE DRAWINGS

Further details are explained below with the help of the examples illustrated in the attached drawings in which.

DESCRIPTION OF THE PREFERRED EMBODIMENT(S)

Figure 1:
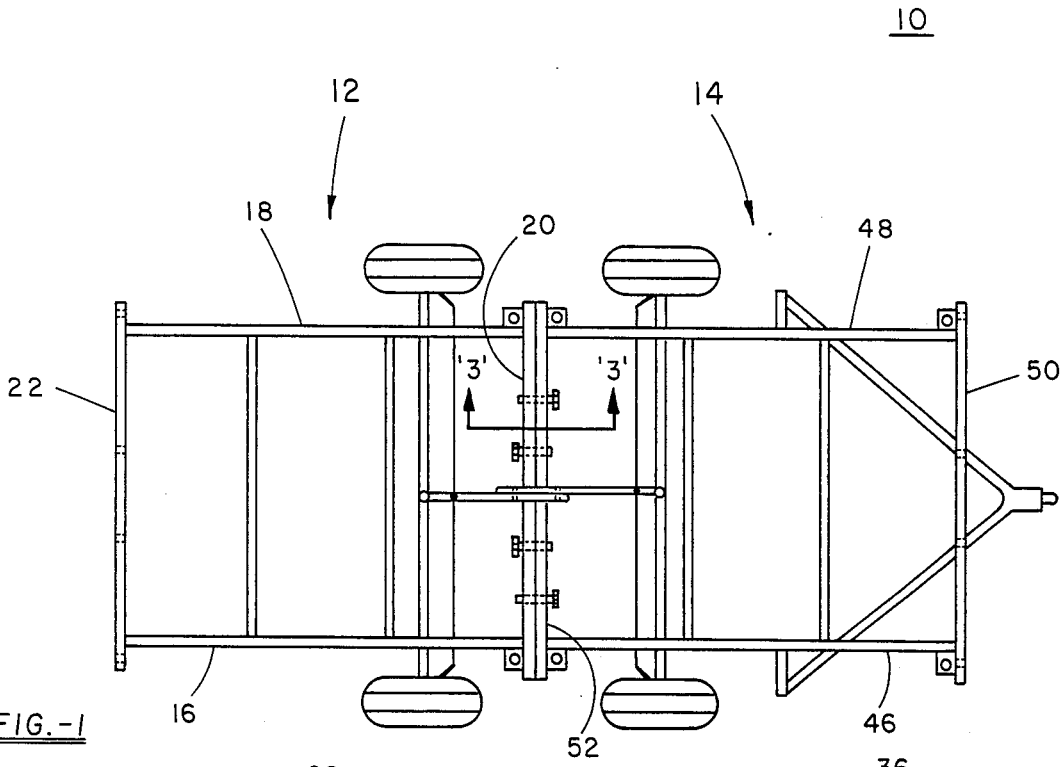
FIG. 1 is a top plane view of the rolling construction platform when arranged to provide a trailer for over the road transportation according to the present invention.
Figure 2:
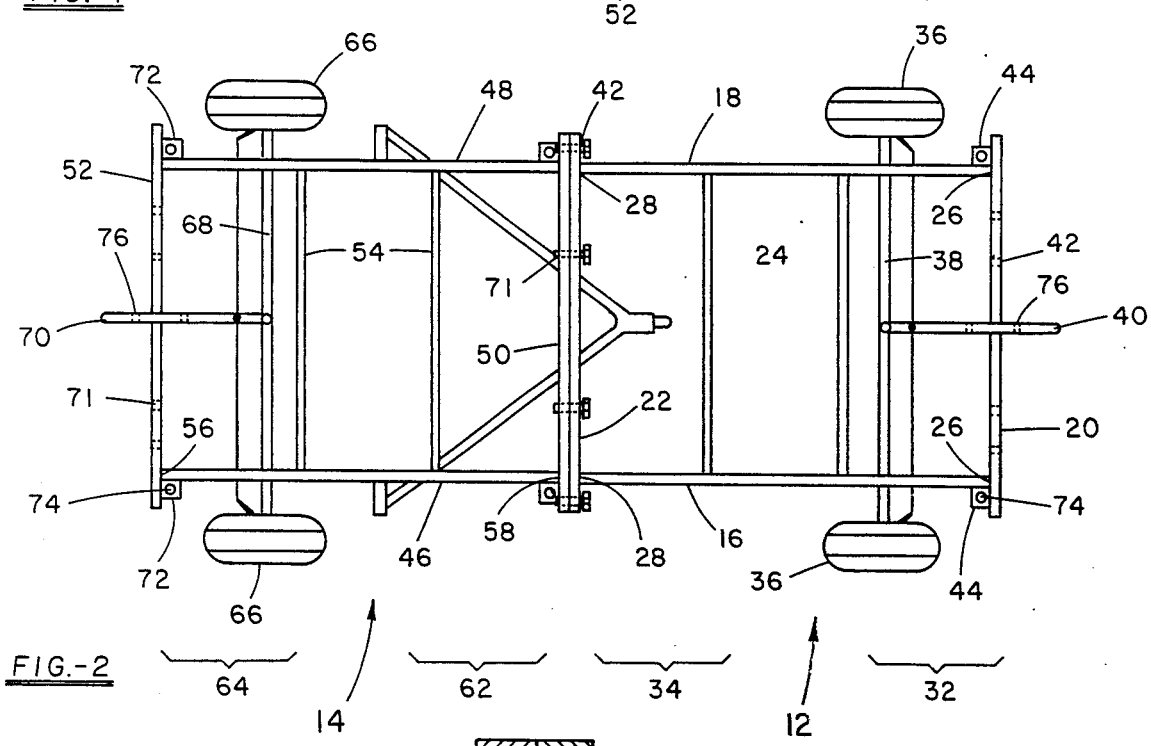
FIG. 2 is a top plane view of the rolling construction platform when arranged to provide a rolling construction platform according to the present invention.
Figure 3:
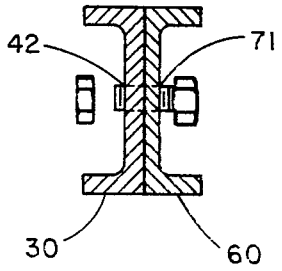
FIG. 3 section taken on line 3—3 of FIG. 1.

There is shown in the drawings a rolling platform 10 for supporting a staging. The rolling platform 10 includes a first frame support section 12 and a second frame support section 14. The first and second frame support sections 12, 14 each having means of supporting a construction staging. The first frame support section 12 includes a first long side frame member 16, a second long side frame member 18, a first forward frame member 20, a back frame member 22 and a series of spaced cross members 24. The first and second long side frame members 16, 18 each having a forward terminal end 26, a back terminal end 28 and a lower surface 30. The first forward frame member 20 connects the forward terminal ends 26 of the first and second long side frame members 16, 18 and the back frame member 22 connects the back terminal ends 28 of the first and second long side frame members 16, 18. The cross members 24 are connected across the area defined by the first and second long side frame members 16, 18, the first forward frame member 20 and the back frame member 22. The cross members 24 are in spaced parallel relation to each other, and to the first forward and back frame members 20, 22.

The area defined by the first and second long side frame members 16, 18, the first forward frame member 20 and the back frame member 22 having a front end 32 and a back end 34. A first pair of wheels 36 connected by a first axle 38 to the front end 32 in close proximity to the forward frame member 20. A first tongue 40 is attached to the first pair of wheels 36. The forward and back frame members 20, 22 have a series of spaced, transverse, through apertures 42 formed therethrough. A first support portion 44, for supporting the staging, is provided at the corners formed by the first forward frame member 20 and the first long side frame member 16 and formed by the first forward frame member 20 and the second long side frame member 18.

The second frame support section 14 includes a third long side frame member 46, a fourth long side frame member 48, a second forward frame member 50, a second back frame member 52 and a series of spaced second cross members 54. The third and fourth long side frame members 46, 48 each have a second forward terminal end 56, a second back terminal end 58 and a second lower surface 60. The second forward frame member 50 connects the second forward terminal ends 56 of the third and fourth long side frame members 46, 48 and the second back frame member 52 connects the second back terminal ends 58 of the third and fourth long side frame members 46, 48. The second cross members 54 are connected across the area defined by the third and fourth long side frame members 46, 48, the second forward frame member 50 and the second back frame member 52. The second cross members 54 are in spaced parallel relation to each other, and to the second forward and back frame members 50, 52. The area defined by the third and fourth long side frame members 46, 48, the second forward frame member 50 and the second back frame member 52 has a front 62 and a back 64. A second pair of wheels 66 is connected by a second axle 68 and attached to the second lower surface 60 in close proximity to the back 64. A second tongue 70 is attached to the second pair of wheels 66 in close proximity to the second back frame member 52. The first and second tongues 40, 70 each extend along a line in parallel relation with the longitudinal midline of the first and second frame support sections 12, 14 and each extends beyond its respective frame support section. The second forward and back frame members 50, 52 each have a series of spaced, transverse, through apertures 71 formed there through. At the corners formed by the second back frame member 52 and the third long side frame member 46 and formed by the second back frame member 52 and the fourth long side frame member 48, second support portions 72 are formed. The first and second support portions 44, 72 each include a stud element for engaging the staging. The first and second tongues 40, 70 each has a series of spaced, through, transverse holes 76 formed therein and each is offset from the longitudinal midline of its respective frame support section 12, 14.

To prepare the rolling platform 10 for public highway travel, the first forward frame member 20 is positioned in abutting, parallel relation to the second back frame member 52 and with the first tongue 40 in parallel relation with and butted against the second tongue 70. The through apertures 42 formed in the first forward frame member 20 are coaxial aligned with the through apertures 71 formed in the second back frame member 52 and the through holes 76 formed in the first tongue 40 are coaxial aligned with the through holes 76 formed in the second tongue 70. Nuts and bolts are now utilized to bolt the first forward frame member 20 to the second back frame member 52 and to bolt the second tongue 70 to the first tongue 40 whereby the first frame support section 12 and the second frame support section 14 are attached together to position the first and second pairs of wheels 36, 66 in tandem when the rolling platform is in transit over the roads.

To use the rolling platform 10 to support staging at the construction site, the back frame member 22 is positioned in abutting, parallel relation to the second forward frame member 50. The through apertures 42 formed in the back frame member 22 are coaxial aligned with the through apertures 71 formed in the second forward frame member 50. Nuts and bolts are now utilized to bolt the back frame member 22 to the second forward frame member 50. At this juncture staging can be positioned on the stud elements 74 and the rolling platform 10 can be easily posted or moved along the line of construction without the necessity of taking the staging down. If desired the first pair of wheels 36 may have a tie rod associated therewith. The first tongue 40 is attached to the tie rod and to the axle 38 of the first pair of wheels 36 and the second pair of wheels 66 may have a tie rod associated therewith. The second tongue 70 is attached to the tie rod and to the axle 68 of the second pair of wheels 66.

What I claim is:

1. A rolling platform for supporting staging comprising a first frame support section and a second frame support section, the first and second frame support sections each having means of supporting staging, the first frame support section including a first long side frame member, a second long side frame member, a forward frame member, and a back frame member, the first and second long side frame members each having a forward terminal end, a back terminal end and a lower surface, the forward frame member connecting the forward terminal ends of the first and second long side frame members and the back frame member connecting the back terminal ends of the first and second long side frame members, the area defined by the first and second long side frame members, the forward frame member and the back frame member having a front end and a back end, a first pair of wheels connected by a first axle to the front end in close proximity to the forward terminal end, a first tongue steerably connected to the first pair of wheels, the forward and back frame members having a series of laterally space through apertures formed therein, the second frame support section including a third long side frame member, a fourth long side frame member, a second forward frame member, and a second back frame member, the third and fourth long side frame members each have a second forward terminal end, a second back terminal end and a second lower surface, the second forward frame member connects the second forward terminal ends of the third and fourth long side frame members and the second back frame member connects the second back terminal ends of the third and fourth long side frame members, the area defined by the third and fourth long side frame members, the second forward frame member and the second back frame member having a front and a back, a coupling means extending forward of the second forward frame member for attaching the rolling platform to a towing vehicle, a second pair of wheels connected by a second axle and attached to the lower surface in close proximity to the back, a second tongue steerably connected to the second pair of wheels in close proximity to the second back frame member, the first and second tongues each extend along a line in parallel relation with the longitudinal midline of the first and second frame support sections and each extending beyond their respective frame support section, the second forward and back frame members having a series of spaced through apertures formed therein, whereby the rolling platform can assume two configurations such that in the first configuration, the first forward frame member and the second back frame member are attached together by means of connectors extending through aligned apertures in the frame members with the coupling means extending forward of the second forward frame member when the rolling platform is in transit over the roads and in the second configuration, the first back frame member and the second forward frame member are attached by means of connectors extending through aligned apertures in the frame members with a respective tongue extending beyond the second back frame member and the first forward frame member for steering of the respective wheel pairs.

2. The rolling platform as set forth in claim 1 wherein support portions for supporting staging is provided at the corners formed by the first forward frame member and the first long side frame member and formed by the first forward frame member and the second long side frame member and at the corners formed by the second back frame member and the third long side frame member and formed by the second back frame member and the fourth long side frame member.

3. The rolling platform as set forth in claim 2 wherein the support portions each include a stud element for engaging staging.

4. The rolling platform as set forth in claim 2 wherein the first pair of wheels have a first pair of tie rods pivotally attached between the first tongue and respective steering knuckles of the first pair of wheels, and the second pair of wheels having a second pair of tie rods pivotally attached between the second tongue and respective steering knuckles of the second pair of wheels.

5. The rolling platform as set forth in claim 1 wherein the first and second tongues each have a series of through holes formed therein which are aligned for securing the tongues together.

6. The rolling platform as set forth in claim 1 wherein the first frame support section includes a series of spaced first cross members, the cross members being connected across the area defined by the first and second long side frame members, the forward frame member and the back frame member in spaced parallel relation to each other and to the forward and back frame members, and the second frame support section includes a series of spaced second cross members, the second cross members being connected across the area defined by the third and fourth long side frame members, the second forward frame member and the second back frame member, in spaced parallel relation to each other and to the second forward and back frame members.

* * * * *